United States Patent [19]

Jäggle et al.

[11] 3,951,119

[45] Apr. 20, 1976

[54] FUEL INJECTION SYSTEM

[75] Inventors: Günther Jäggle, Stuttgart; Klaus-Jürgen Peters, Affalterbach; Volkhard Stein, Stuttgart; Herbert Scharl, Ditzingen, all of Germany

[73] Assignee: Robert Bosch G.m.b.H., Stuttgart, Germany

[22] Filed: Apr. 17, 1974

[21] Appl. No.: 461,623

[30] Foreign Application Priority Data

June 9, 1973 Germany ..... 2329667

[52] U.S. Cl. ..... 123/139 AW; 123/119 R; 123/139 E

[51] Int. Cl.[2] ..... F02M 39/00

[58] Field of Search ..... 123/139 AW, 138 BG, 123/139 R, 140 CC, 179 R, 139 E; 261/39 A, 50 A, 50 AA

[56] References Cited

UNITED STATES PATENTS

| | | | |
|---|---|---|---|
| 3,473,523 | 10/1969 | Hilborn | 123/139 AW |
| 3,589,384 | 6/1971 | Eckert | 123/139 AW |
| 3,628,515 | 12/1971 | Knapp | 123/139 AW |
| 3,630,643 | 12/1971 | Eheim | 123/139 E |
| 3,680,535 | 8/1972 | Eckert | 123/139 AW |
| 3,713,430 | 1/1973 | Knapp | 123/139 AW |
| 3,728,993 | 4/1973 | Eckert | 123/139 AW |
| 3,730,155 | 5/1973 | Knapp | 123/119 R |
| 3,739,758 | 6/1973 | Knapp | 123/119 R |
| 3,765,387 | 10/1973 | Knapp | 123/139 AW |
| 3,777,725 | 12/1973 | Stumpp | 123/139 AW |

*Primary Examiner*—Charles J. Myhre
*Assistant Examiner*—Daniel J. O'Connor
*Attorney, Agent, or Firm*—Edwin E. Greigg

[57] ABSTRACT

A fuel injection system for substantially continuous injection into a suction tube of a mixture-compressing, spark plug-ignited internal combustion engine includes a fuel line and a fuel pump. A measuring member and an arbitrarily actuatable throttle flap are disposed, one behind the other, in the suction tube. The measuring member is displaceable in proportion to air quantity and against a resetting force which is normally constant but which is changeable in dependence on engine parameters. A metering valve having a movable part is disposed in the fuel line and coupled to the measuring member. The measuring member actuates the movable part for metering fuel quantity in desired proportion with respect to air quantity. A regulating mechanism, which includes a piston, is actuated in dependence on fuel pressure prevailing downstream from the fuel pump. The piston acts against the force of a spring.

8 Claims, 3 Drawing Figures

FUEL INJECTION SYSTEM

BACKGROUND OF THE INVENTION

This invention relates to a fuel injection system which includes a regulator element. The invention relates, more particularly, to a fuel injection system which provides substantially continuous injection into the suction tube of a mixture-compressing, spark plug-ignited internal combustion engine, in whose suction tube there are disposed a measuring member and an arbitrarily actuatable throttle flap, one behind the other. The measuring member is pivoted in proportion to the air quantity flowing and against a normally constant resetting force which may, however, be changed in dependence on motor parameters. The measuring member actuates the movable part of a valve disposed in the fuel line for the purpose of metering a fuel quantity which is in a desired proportion to the air quantity.

Fuel injection systems of the above-mentioned type have the purpose of effecting automatically a favorable fuel-air mixture for all operational conditions of the internal combustion engine. This is done to make possible a complete combustion of the fuel and in order to avoid, or at least sharply reduce, the creation of toxic exhaust components while maintaining the highest possible performance or the least possible fuel consumption of the internal combustion engine. To achieve this purpose, the fuel quantity must be metered to the internal combustion engine very precisely according to the requirements of every operational condition of the engine. The proportionality between air quantity and fuel quantity must be changed in dependence on motor parameters such as rpm, load and temperature.

In known fuel injection systems of this type, the fuel quantity is metered as nearly as possible proportional to the air quantity streaming through the suction tube, and the ratio of the metered fuel quantity to the air quantity is changeable in dependence on motor parameters by changing the resetting force acting on the measuring member. However, in those fuel injection systems, it is possible for the measuring member to be still pivoted out of its normal position even after the ignition has been shut off and while the engine is running down; this results in additional fuel being metered and injected which can cause auto-ignition (dieseling) in sensitive internal combustion engines.

SUMMARY OF THE INVENTION

It is the principal object of the present invention to provide an improved fuel injection system in which the injection of fuel after ignition shut-off while the engine is running down is prevented.

The foregoing object, as well as others which are to become clear from the text below, is achieved in a fuel injection system for substantially continuous injection into a suction tube of a mixture-compressing, spark plug-ignited internal combustion engine. The system includes a fuel line; a fuel pump; a measuring member and an arbitrarily actuatable throttle flap disposed, one behind the other, in the suction tube, the measuring member being displaceable in proportion to air quantity and against a resetting force which is normally constant but which is changeable in dependence on engine parameters; a metering valve, having a movable part and disposed in the fuel line, coupled to the measuring member which actuates the movable part for metering fuel quantity in desired proportion with respect to air quantity; and a regulating mechanism including a piston which is actuated in dependence on fuel pressure prevailing downstream from the fuel pump and a spring against the force of which the piston acts.

In a preferred arrangement, the regulating mechanism is disposed in a housing which also serves as the housing of the metering valve.

An end of the piston of the regulating mechanism preferably is provided with an offset region of smaller diameter, this end including a control surface and facing in the direction of fuel flow.

The end of the piston is desirably substantially conical in shape.

In preferred form, the conical end is interrupted by a groove within which a sealing ring is disposed.

A fuel return line is desirably included and the piston is provided with an annular groove which communicates with the fuel return line.

The above-mentioned annular groove, in a preferred form of the system, communicates through bores in a chamber formed by a side of the piston turned away from the fuel flow and a guide bore.

The fuel injection system has a metering valve which includes a control piston, a leakage line being provided so that leakage occurring at the control piston can be drained.

DESCRIPTION OF THE PREFERRED EMBODIMENT

Figure 1:
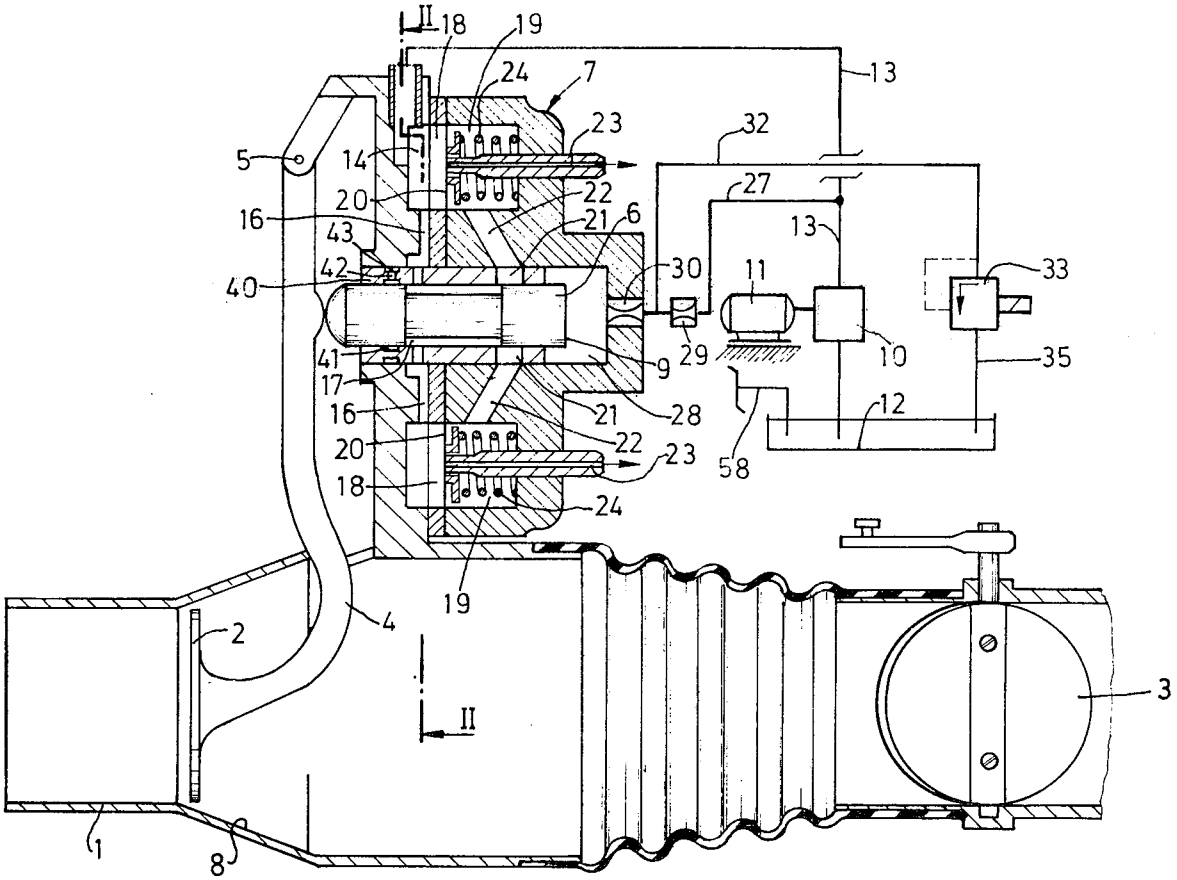
FIG. 1 is an illustration, partially in section and partially schematic, of an illustrative embodiment of a fuel injection system according to the present invention.
Figure 2:
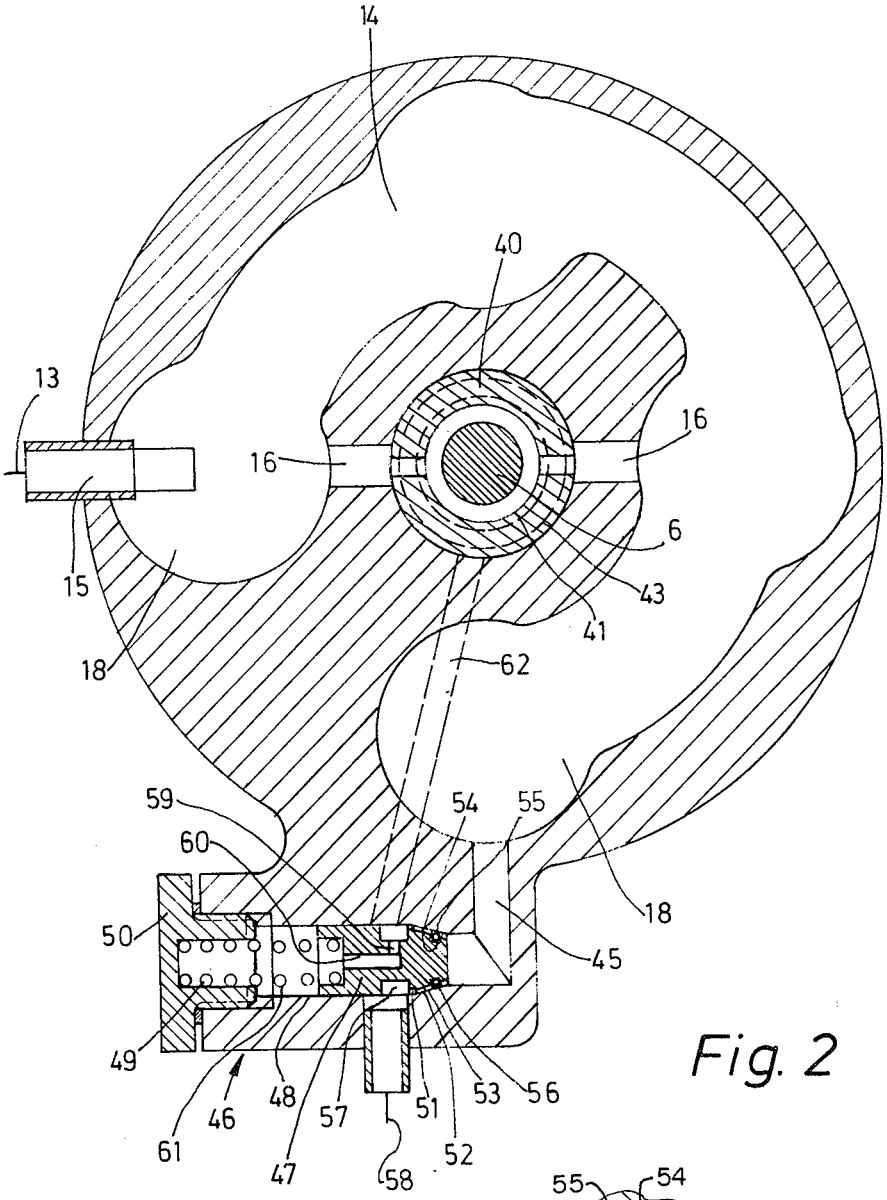
FIG. 2 is a cross-sectional view of a portion of the fuel injection system of FIG. 1, the section being taken along section line II — II.
Figure 3:
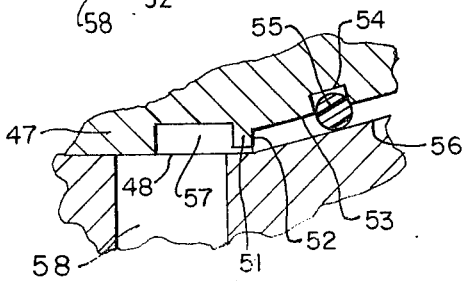
FIG. 3 is an enlarged view of the tip of the regulating piston.

As illustrated in FIGS. 1 and 2, a fuel injection system according to the present invention includes a conventional suction tube 1 of an internal combustion engine. Gas flows from left to right past a pivotably suspended measuring member 2, and also past an arbitrarily actuatable throttle flap 3, into the cylinders (not shown) of an internal combustion engine. The measuring member 2 is constituted by a plate lying transverse to the direction of flow and fastened, in its central region, to a pivoting lever 4 which is pivotable in a plane about a pivotal point 5. The measuring member 2 moves within the suction tube 1 according to a particular law which is approximately a linear function of the air quantity flowing through the suction tube 1, and if the return force acting on the measuring member 2 is constant and if, also, the air pressure prevailing ahead of the measuring member 2 is constant, then the pressure prevailing between the measuring member 2 and the throttle flap 3 is also nearly constant.

The measuring member 2, via the pivoting lever 4, immediately actuates a control piston 6 of a metering-and-quantity dividing valve 7. A face 9 of the control piston 6 which faces away from the pivotal lever 4 is acted upon by a fluid under constant pressure serving as the return force for the measuring member 2.

The supply of fuel occurs by means of a fuel pump 10 which is driven by an electric motor 11 and which pumps the fuel from a container 12 through a line 13 to the metering-and-quantity dividing valve 7. Fuel flows from the line 13 into an inlet tube 15 in the housing of the metering valve 7. The inlet tube 15 communicates through an annular channel 14 and channels 16 with an annular groove 17 in the control piston 6 which further communicates with chambers 18 so that one side of a membrane 20 is acted upon by this fuel pressure. Depending on the position of the control piston 6, the annular groove 17 more or less overlaps control slits 21. The control slits 21 communicate via channels 22, with a chamber 19 which is separated from the chamber 18 by the membrane 20. From the chamber 19, fuel flows through the channels 23 to the individual injection valves (not shown) and which are disposed, in the vicinity of the engine cylinders in the suction tube 1. The membrane 20 serves as the movable part of a flat seated valve which is held open by a spring 24 when the fuel injection system is inoperative. The membrane 20 movement effected by the chambers 18 and 19 has the effect that the pressure drop at the metering valve is substantially constant independently of the degree of overlap which exists between the annular groove 17 and the control slits 21 and hence independently of the amount of fuel flowing to the injection valves. This fact guarantees that the setting path of the control piston 6 and the metered fuel quantity are proportional. During the pivotal motion of the pivoting lever 4, the measuring member 2 is moved into a conical region 8 within the suction tube 1 so that the changing annular cross section between the plate of the measuring member 2 and the conical region 8 of the suction tube 1 is proportional to the setting path of the measuring member 2. If this prerequisite is met, there then exists a linear dependence of the setting motion of measuring member 2 and the displacement motion of control piston 6 so that the amount of fuel metered to the airstream is always proportional to the air quantity flowing through the suction tube.

The pressure fluid acting as a constant resetting force on control piston 6 is fuel. For the purpose of supplying this fuel, a line 27 branches off from the line 13 and terminates in a chamber 28 into which also extends the control piston 6 with the face 9 turned away from the pivoting lever 4. A pre-throttle 29 is disposed in the line 27. The supply line 13 of the metering valve 7 is uncoupled by the pre-throttle 29 from the control pressure circuit constituted by the line 27 and a line 32 associated with a pressure control valve 33. Branching off from the line 27 at a point lying behind the pre-throttle 29 is the line 32 leading to the pressure control valve 33 and the flow continues through a return line 35 leading to the fuel container 12. The fuel-air mixture must be made richer or leaner depending on the operational condition of the internal combustion engine and, for this reason, the pressure control valve 33 causes a change of the pressure in the pressure fluid determining the resetting force and it does so in dependence on a motor parameter and the new pressure and, consequently, the corresponding resetting forces are again held constant.

The supply of pressure to the chamber 28 occurs through a damping throttle 30 which limits excessive oscillation of the measuring member 2 during throttle pedal application or due to suction pulses of the internal combustion engine.

The control piston 6 of the metering valve 7 glides in a bushing 40 which has an annular groove 41 nearest the control piston 6 and also another annular groove

43, connected with the first annular groove by a bore 42, permitting drainage of fuel leaking at the control piston 6, as is shown in FIG. 2.

As also shown in FIG. 2, a line 45 branches off from the annular channel 14 and leads to a regulating mechanism 46 which holds the fuel pressure at a nearly constant value prior to metering. The regulating mechanism 46 has a piston 47 gliding in a guide bore 48 in opposition to the force of a spring 49. The end of the spring 49 facing away from the piston 47 is supported on a threaded member 50. On that end of the piston 47 facing the direction of fuel flow, it has an offset portion 51 of smaller than maximum diameter with a control surface 52. Adjacent to the offset portion 51 is a conical region 53 which is interrupted by a groove 54 carrying a sealing ring 55 and which extends into a conical part 56 within the guide bore 48. An annular groove 57 in the piston 47 communicates with a fuel return line 58 and hence through bores 59, 60, with a chamber 61 formed by the side of the piston 47 facing away from the direction of fuel flow and by the guide bore 48.

The leakage fuel quantity occurring at the control piston 6 of the metering valve 7 is collected in the annular groove 41 in the bushing 40 and is carried through the bore 42 and the annular groove 43 into a leakage line 62 which terminates in the annular groove 57.

The method of operation of the regulating mechanism 46 is as follows: when the operating pressure of the fuel injection system is exceeded, the piston 47 which communicates with the annular channel 14 through the line 45 is displaced against the force of the spring 49 into a position in which the control surface 52 overlaps the fuel return line 58 to a higher or lower degree, and a corresponding fuel quantity can flow back into the fuel container 12. The initial compression of the spring 49 is so chosen that just prior to the overlapping of control surface 52 and the fuel return line 58, the lowest permissible operating pressure for the system results.

After the fuel supply has been shut off, that amount of fuel which is composed, on the one hand, by the displacement volume of the piston 47 from its regulatory position into its quiescent position and, on the other hand, by the storage capability of the flexible fuel lines from the fuel pump 10 up to the regulating mechanism 46 and which occurs due to the drop of pressure, must flow out into the annular groove 57 and hence into the fuel return line 58 through the clearance between the piston surface and the guide bore 48. This clearance is dimensioned so that the reduction of pressure from the system operating pressure to the closure pressure is as rapid as possible. This prevents the injection of fuel at a time when the ignition is shut off and the motor is running down but when the measuring member 2 and the control piston 6 are still displaced; such fuel injection would lead to auto-ignition (dieseling) in sensitive engines. The gap between the control surface 52 and the annular groove 57 is made small, which prevents asymmetric pressure distributions with their correspondingly large hysteresis effects.

The distance between the operating position and the quiescent (rest) position of the piston 47 is so dimensioned that, just prior to the seating and sealing of the sealing ring 55 on the conical portion 56 of the guide bore 48, the spring 49 has relaxed so far that the system pressure has dropped below the opening pressure of the injection valves, but it is higher than the vapor pressure of the fuel in a hot engine.

The lift-off of the piston 47 from its quiescent position occurs again only at a higher system pressure because the diameter of the sealing ring 55 is smaller than that of the control surface 52.

When large amounts of fuel flow through the inlet of the fuel return line 58, the resulting venturi effect creates a reduced pressure whose effect is transmitted through the annular groove 57 to the leakage line 62 and through the bores 59, 60 to the chamber 61 and thus counteracts the force of the spring 49 in an advantageous manner. Because of this construction, the desired flattened characteristic control curve can be achieved during periods of greater fuel throughput.

It is to be appreciated that the foregoing detailed description of the preferred embodiment of a fuel injection system has been given by way of example, not of limitation. Many variants and other embodiments are possible without departing from the spirit and scope of the present invention, the scope being defined in the appended claims.

That which is claimed is:

1. A fuel injection system for substantially continuous injection into the suction tube of a mixture-compressing, spark plug-ignited internal combustion engine comprising, in combination:

a. a fuel line;

b. a fuel pump;

c. a measuring member and an arbitrarily actuatable throttle flap disposed, one behind the other, in the suction tube, said measuring member being displaceable in proportion to air quantity and against a resetting force which is normally constant but which is changeable in dependence on engine parameters;

d. a metering valve, having a movable part and disposed in said fuel line, coupled to said measuring member which actuates said movable part for metering fuel quantity in desired proportion with respect to air quantity; and e. regulating means including a piston which is actuated in dependence on fuel pressure prevailing downstream from said fuel pump and which serves to regulate said fuel pressure and a spring means against the force of which said piston acts.

2. A fuel injection system according to claim 1, wherein said regulating means is disposed in a housing which constitutes the housing of said metering valve.

3. A fuel injection system according to claim 1, wherein a portion of said piston of said regulating means which faces the direction of fuel flow is provided with an offset region of smaller diameter than the maximum diameter of the piston, said offset region including a control surface.

4. A fuel injection system according to claim 3, wherein the end of said piston of said regulating member which faces the direction of fuel flow is substantially conical in shape.

5. A fuel injection system according to claim 4, further including a sealing ring, and wherein said substantially conical shape is interrupted by a groove within which is disposed said sealing ring.

6. A fuel injection system according to claim 1, further including a fuel return line, and wherein said piston has an annular groove which communicates with said fuel return line.

7. A fuel injection system according to claim 6, further including a guide bore which, with a side of said piston turned away from the direction of fuel flow, forms a chamber, and wherein said annular groove communicates through bores with said chamber.

8. A fuel injection system according to claim 6, wherein said metering valve includes a control piston and further includes a leakage line whereby leakage occurring at said control piston can be drained through said leakage line into said annular groove.

* * * * *